US005743312A

United States Patent [19]

Pfeifer et al.

[11] Patent Number: 5,743,312

[45] Date of Patent: Apr. 28, 1998

[54] COMPONENT MIXING APPARATUS AND SYSTEM INCLUDING A MOVABLE CANNULA

[75] Inventors: Thomas Pfeifer, Eschenburg; Dietmar Weitzel, Marburg; Wolfgang Kneip, Marburg; Bernhard Vohwinkel, Marburg; Axel von Brand, Budenheim, all of Germany

[73] Assignee: Behringwerke Aktiengesellschaft, Marburg, Germany

[21] Appl. No.: 629,630

[22] Filed: Apr. 9, 1996

[30] Foreign Application Priority Data

Apr. 11, 1995 [DE] Germany ..... 195 13 666.7

[51] Int. Cl.[6] ..... B65B 1/04

[52] U.S. Cl. ..... 141/329; 141/372; 141/375; 141/383; 604/416

[58] Field of Search ..... 141/329, 330, 141/357, 362, 366, 368, 372, 375, 379, 383, 18; 604/411–416, 89, 92

[56] References Cited

U.S. PATENT DOCUMENTS

| | | | |
|---|---|---|---|
| 3,872,867 | 3/1975 | Killinger | 141/329 |
| 4,722,733 | 2/1988 | Howson et al. | 141/330 |
| 4,936,841 | 6/1990 | Aoki et al. | 604/413 |
| 5,350,372 | 9/1994 | Ikeda et al. | 141/329 |

FOREIGN PATENT DOCUMENTS

| | | |
|---|---|---|
| 0 592 689 A1 | 4/1994 | European Pat. Off. . |
| 0 598 918 A1 | 6/1994 | European Pat. Off. . |
| 3817 101 A1 | 11/1989 | Germany . |
| WO 95/00101 | 1/1995 | WIPO . |

*Primary Examiner*—Renee S. Luebke
*Assistant Examiner*—Steven O. Douglas
*Attorney, Agent, or Firm*—Finnegan, Henderson, Farabow, Garrett & Dunner, L.L.P.

[57] ABSTRACT

An apparatus for combining liquid or solid components stored in containers includes a cylindrical hollow body for receiving end closures of the containers and at least one cannula for penetrating the end closures. The cannula is mounted in a cannula holder movable in the hollow body, and retainer bridges connect the cannula holder to an inner wall surface of the hollow body. The retainer bridges fracture after the cannula penetrates the end closure in the first container so that the cannula moves toward the second container to penetrate the closure in the second container.

Also disclosed is a system including the apparatus, two containers, and outer packaging enclosing the containers and the hollow body.

20 Claims, 4 Drawing Sheets

COMPONENT MIXING APPARATUS AND SYSTEM INCLUDING A MOVABLE CANNULA

BACKGROUND OF THE INVENTION

1. Field of the Invention

The invention relates to an apparatus for combining a first liquid component and a second solid or liquid component by means of reduced pressure under sterile conditions, having a first container receiving the first component and a second container under reduced pressure receiving the second component, and a cylindrical hollow body for receiving the first container in the region of its closure in a first hollow body orifice and a second hollow body orifice arranged diametrically to this for receiving the second container in the region of its closure, and at least one cannula which is mounted in the hollow body and is displaceable in its longitudinal direction for penetrating the closure stoppers sealing each of the containers, the cannula being mounted in a cannula holder.

2. Description of the Related Art

An apparatus which forms a component of a preassembled system for transferring liquids is disclosed in DE 38 17 101 A1. The system permits the second container together with the attached apparatus to be brought into commerce, so that to transfer liquid into this second container, only the first container needs to be attached to the unit formed by the second container and the apparatus. The displaceable mounting of the cannula in the hollow body and a resistance to passage extending into the path of the cannula holder ensure that although the second container inserted into the hollow body is connected to this, it does not come into contact with the cannula. Only after the first container receiving the liquid has been pierced is the resistance to passage overcome on further insertion of the vessel port of the first container and the closure stopper of the second container is penetrated, the interior of the two containers being joined by the cannula.

In the known apparatus, a surrounding projection is provided both on the cannula holder and on a storage sleeve forming a component of the hollow body. The resistance to passage beyond the storage sleeve-side projection resulting on contact of the two projections is greater than the resistance to penetration of the cannula on insertion into the closure stopper of the first container. It is a disadvantage in this case that the design of the parts having the projections requires an exact dimensioning of the outer projection diameter of the cannula holder and inner projection diameter of the storage sleeve in order to achieve the penetration in time sequence of the closure stoppers of the vessels. The projections necessitate moreover an increased manufacturing expenditure on the apparatus, based on the production of the cannula holder and the hollow body, moreover, assembly of the apparatus in the region of the cannula holder is highly complex.

SUMMARY OF THE INVENTION

It is an object of the present invention to develop an apparatus of the type mentioned at the outset in such a manner that this makes possible uncomplicated, confusion-proof and irreversible handling with a structurally simple design.

The object is achieved with an apparatus of the type mentioned at the outset by the fact that the cannula holder is designed as a lamellar body orientated perpendicularly to the longitudinal direction of the hollow body and connected via retainer bridges to the inner wall of the hollow body, the retainer bridges being able to be ruptured by applying a manual force which is greater than the penetration force of the cannula on penetrating the closure stopper of the first container.

According to the invention, the cannula holder, prior to the cannula puncturing the closure stopper of the second container, is thus fixed to the inner wall of the hollow body by the lamellar retaining bridges. It is therefore only possible to displace the cannula when the retainer bridges have been ruptured in advance by applying the manual force. This ensures a reliable sequential course of movement. The design of the apparatus permits it to have a simple structure, in that, if appropriate apart from the cannula, it is fabricated as an injection-molded plastic component.

According to a particular embodiment of the invention it is provided that the cannula holder is connected to guide lugs directed toward the inner wall of the hollow body. After the retainer bridges have been separated, these guide lugs enable substantially tilt-free guidance of the cannula holder relative to the inner wall of the hollow body, and thus a substantially exact guidance of the cannula in the puncture area to the second container, the cannula additionally being held in the closure stopper of the first container.

The hollow body advantageously has an orifice with a circular cross section. In particular in the case of such a structure of the hollow body orifice, a triangular or circular design of the cannula holder suggests itself. The cannula holder has, for example, the shape of an equilateral triangle having three guide lugs which are joined to the cannula holder in the region of the centers of the sides of the triangle of the cannula holder. In the case of a circular cannula holder, preferably four guide lugs, arranged offset from one another in each case by 90 degrees, are joined to the cannula holder at the periphery thereof. The guide lugs, radially outward, can have guide tabs extending concentrically to the cannula and extending in the longitudinal direction of the hollow body.

A preferred development of the invention provides that directing strips running in the longitudinal direction of the hollow body are joined to the inner wall of the hollow body, between which directing strips are arranged the guide lugs or the corners of the cannula holder. Each guide lug should be joined in this case via a central bridge to the cannula holder and two directing strips should engage with each guide lug in the region of the central bridge. The structure of the hollow body with directing strips causes a defined positioning of the cannula holder relative to the hollow body during its displacement in the longitudinal direction and during this also prevents rotation or tipping of the cannula holder relative to the hollow body.

To improve the guidance of the container in the hollow body, the latter is advantageously lengthened in the region of at least one end in parallel to the container to be received by the assigned hollow body orifice. The lengthening has the effect that the container is not only held in the region of the container neck having the closure stopper, but the lengthened section of the hollow body at least in part surrounds at a greater or lesser distance the generally expanded, voluminous region of the container, so that tilting of the container in the hollow body is excluded. This is of importance in particular for the container which receives the substance under reduced pressure or vacuum conditions, which therefore does not need to be actively guided on transfer of the liquid into this container, but this is only necessary in the case of the other container receiving the liquid. The lengthened section of the hollow body expediently has an internal diameter which is slightly larger than the external diameter of the container. By this means, not only is inadvertent tilting of the container prevented, but the container is guided in a defined manner.

It is provided, in particular, that the apparatus forms, with the two containers, a preassembled, sterilely packaged system, in which the two containers are held in the cylindrical hollow body out of contact with the cannula and a packing material sterilely encloses the containers and the hollow body.

Since the transfer of the liquid is possible under sterile conditions in an outer packaging, a transfer system and a packaging are thus available which considerably simplify and accelerate the mixing of the components situated in the containers and permit preparation completely separated in time from direct application, and enable storage of the reconstituted components for several days. The structure and arrangement of the transfer system enable a rapid, reliable, confusion-free and irreversible transfer of the component situated in the first container into the second container containing the other component with the least possible effort by the user and maintaining sterility even after the components have been combined.

Further features of the invention are presented in the subclaims, the description of the figures and the figures themselves, it being noted that all individual features and all combinations of individual features are essential to the invention.

BRIEF DESCRIPTION OF THE DRAWINGS

In the figures, the invention is described by way of example with reference to a plurality of embodiments, without being restricted to these. In diagrammatic representation.

DESCRIPTION OF THE PREFERRED EMBODIMENTS

Figure 1:
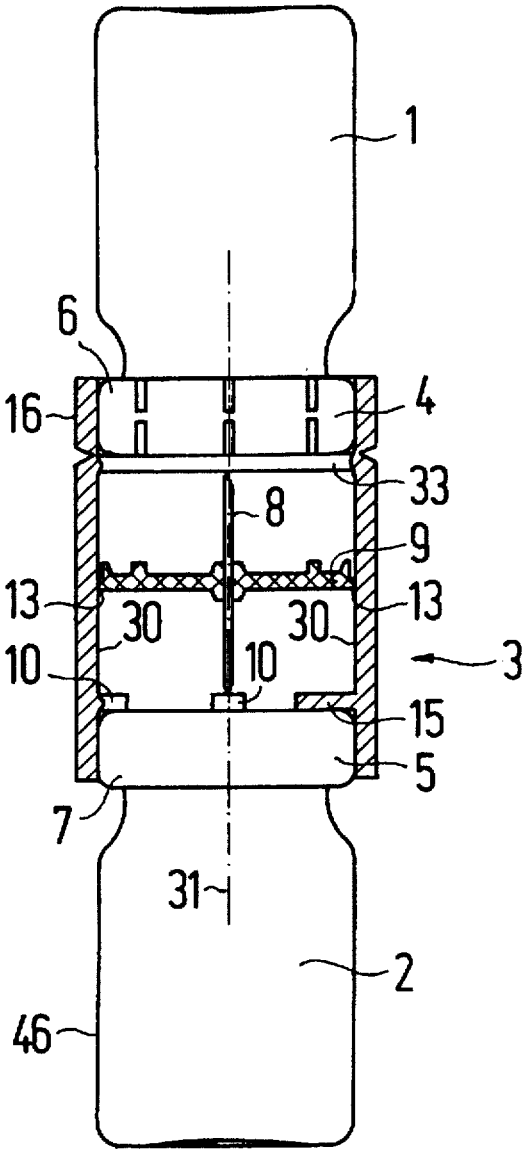
FIG. 1 shows the fundamental structure of a preassembled transfer system using the transfer apparatus, shown in a longitudinal section through the apparatus.

FIG. 1 shows a cylindrical hollow body 3, whose two hollow body orifices 6 and 7 have the same internal diameters. The upper hollow body orifice 6, relative to the orientation of FIG. 1, serves to receive a bottle 1 receiving a liquid, the lower orifice 7 serves to receive a bottle 2 receiving a substance under reduced pressure or vacuum conditions. A rubber stopper, not shown, which is retained by means of a beaded cap 4 and 5, seals the orifice of each bottle i and 2. In the region of each beaded cap 4 and 5, the bottle 1 and 2 is inserted into the hollow body 3 and held by this. Roughly in the region of halfway along the hollow body 3 is arranged a lamellar cannula holder 9 within the hollow body 3, which cannula holder is positioned perpendicularly to the central longitudinal axis 31 of the hollow body 3. The cannula holder 9 is fixed to the inner wall 30 of the hollow body 3 via a plurality of radially running retainer bridges 13. The cannula holder 9 has a through-hole to receive a cannula 8 whose through-axis coincides with the central longitudinal axis 31.

Figure 2:
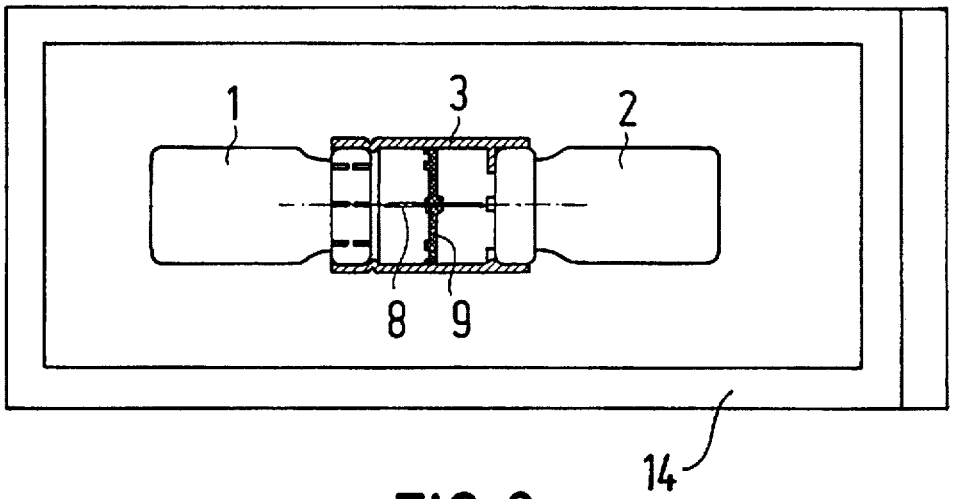
FIG. 2 shows the preassembled transfer system according to FIG. 1 which is received by a sterile outer packaging.

The bottle 2, after it is inserted into the hollow body 3, contacts stops 10 joined to the inner wall 30 of the hollow body 3, so that the bottle cannot be pushed further into the hollow body 3 in the direction of the cannula 8, but is rather clamped between the assigned inner wall section of the hollow body 3. The bottle 1 receiving the liquid, in contrast, in a preassembled position is held in a section of the hollow body 3 facing the actual hollow body orifice region, an internal annular bulge 33 orientated in parallel to the cannula holder 9 projecting into the path of movement of the beaded cap 4 and thus defining the assembly position. In the preassembled position shown in FIG. 1 of the transfer system formed from the two bottles 1 and 2 and the hollow body 3 with cannula holder 9 and cannula 8, the beaded caps 4 and 5 and thus the rubber stoppers for sealing the bottles 1 and 2 are situated at a slight distance from the two ends of the cannula 8. In this state, the transfer system is already sealed into a peelable outer packaging 14 at the premises of the pharmaceutical manufacturer and sterilized, as is shown in FIG. 2. This outer packaging 14 comprises a deep-drawable soft blister film, preferably PA/PE and a sterilizable, sealable medical paper or a polyethylene spun web. After the labelled and assembled units have been sealed in, sterilization is carried out, for example with ethylene oxide. In an appropriately formed secondary packaging, the user then carries out the mixing of the components in the sterile outer packaging, maintaining sterility despite the piercing of the individual containers.

Figure 3A:
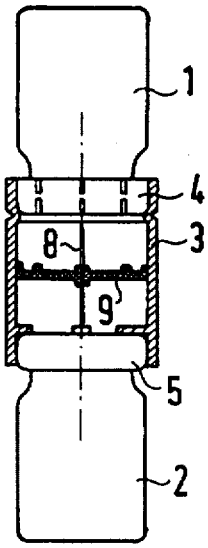
FIG. 3*a* shows a reduced representation of the preassembled transfer system, i.e. before the first container is pierced.
Figure 3B:
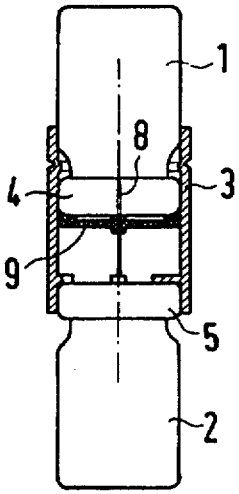
FIG. 3*b* shows the transfer system according to FIG. 3*a* after the first container is pierced.
Figure 3C:
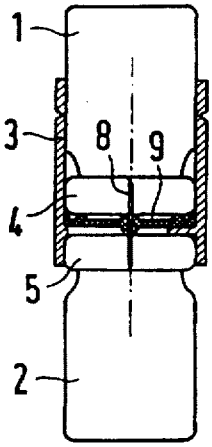
FIG. 3*c* shows the transfer system according to FIGS. 3*a* and 3*b* after the second container is pierced.

FIGS. 3*a* to 3*c* clarify the processes in order to combine the components. FIG. 3*a* shows the proassembled system as depicted in FIG. 1. Starting from this, the bottle 1 receiving the liquid is pushed further into the hollow body 3, the cannula 8 penetrating the rubber closure stopper of the bottle 1. This is possible because the impression or penetration force of the cannula 8 into or through the rubber stopper of the bottle 1 is less than the force which is necessary to separate the cannula holder 9 which is joined via the retainer bridges 13 to the hollow body 3 therefrom. In the advanced position of the bottle 1 as shown in FIG. 3*b*, in which the cannula 8 has penetrated the rubber stopper, the beaded cap 4 of this bottle 1 comes into abutment with the cannula holder 9, the insertion force manually exerted on the bottle 1 for pushing the bottle 1 into the hollow body 3 being transmitted directly to the cannula holder 9. When a correspondingly high manual force is applied, the retainer bridges 13 tear, so that the bottle 1 together with the cannula holder 9 and with it the cannula 8 is further pushed inside the hollow body 3 in the direction of the bottle 2, so that the cannula 8 penetrates the rubber stopper of this bottle 2. The reduced pressure present in the bottle 2 sucks the liquid out of the bottle 1 into the bottle 2 and leads to the dissolution or mixing of the solid or liquid component present in this. The system with the cannula 8 situated in the transfer position is shown in FIG. 3*c*.

Figure 4A:
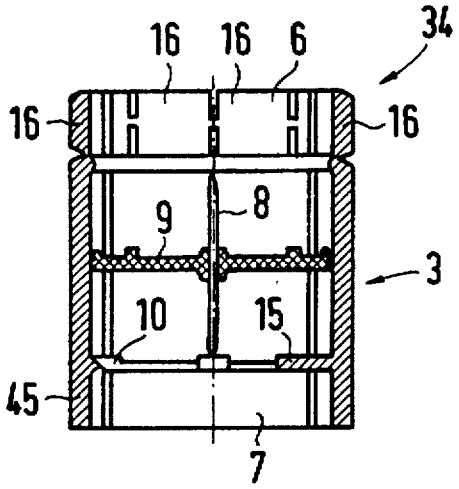
FIG. 4*a* shows an enlargement of the transfer apparatus shown in FIG. 1, depicted in a longitudinal central section.
Figure 4B:
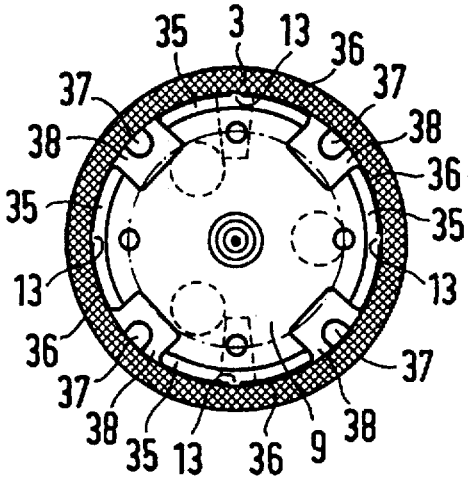
FIG. 4*b* shows a section through the embodiment according to FIG. 4*a*, sectioned perpendicularly to the longitudinal axis of the cannula in the region of the cannula holder.

FIGS. 4*a* and 4*b* show in detail the apparatus described in FIGS. 1 to 3*c* of the transfer system for combining the components. In this embodiment of the apparatus, the hollow body 3 is constructed in the region of the hollow body orifice 6 as a collar 34 having retainer bridges 16 joined together only by thin points. By this means it is possible to use bottles 1 of differing volume, for example all injection bottles from 6 to 100 ml, since on activating the bottle having a nominal volume greater than or equal to 10 ml, insertion into the hollow body 3 is only possible if the ring first used for fixing is broken and provides space for the greater body diameter of the bottle 1.

As can be taken, in particular, from the representation of FIG. 4*b*, the cannula holder 9 essentially has the shape of a circle and is provided with four guide lugs 35 which are joined to the cannula holder 9 at the periphery thereof each offset by 90° from one another. The guide lugs 35, radially outward, have a guide surface 36 extending concentrically to the cannula 8 and extending in the longitudinal direction of the hollow body 3. This guide surface is arranged at a slight distance from the inner wall 30 of the hollow body 3, so that the cannula holder 9 after the rupturing of the retainer bridges 13 can be displaced without play and thus with proof against tilting in the hollow body 3. Moreover, the hollow body 3 is provided internally with four ribs 37 running in the longitudinal direction of the hollow body 3, each arranged offset from one another by 90°, which ribs predetermine the receiving diameter of the hollow body 3 for the bottle 1 and thus ensure exact positioning of the bottle 1, insertion of this bottle 1 being able to proceed with low exertion of force because of the abutment of the bottle by its beaded cap 4 on the ribs 37. The ribs 31 pass through recesses 38 between the guide lugs 35.

The reference number 15 denotes a retainer bridge arranged in the plane of the stops 10 and joined to the interior of the hollow body 3, which retainer bridge prevents the cannula holder 9 from falling out of the hollow body 3 or the cannula 8 held in the cannula holder 9 from remaining stuck in the rubber stopper of the bottle 2 on extracting the bottle 2 from the hollow body 3 after reconstitution of the components.

Figure 5A:
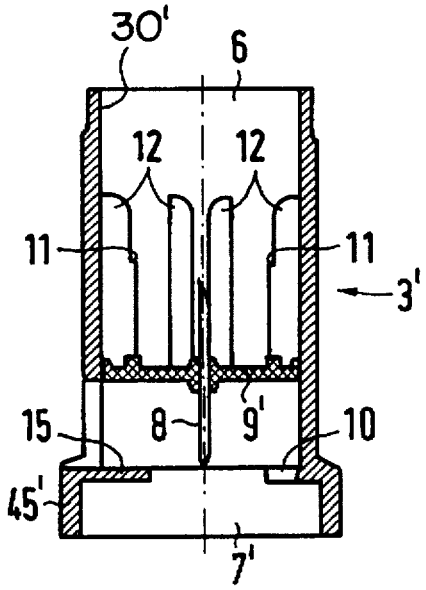
FIG. 5*a* shows a structure of the apparatus modified with respect to the embodiment according to FIGS. 4*a* and 4*b*, in a longitudinal central section.
Figure 5B:
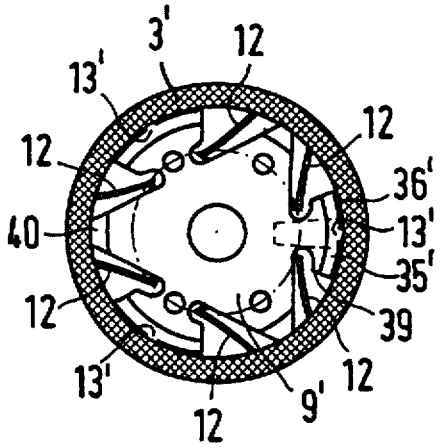
FIG. 5*b* shows a section through the embodiment according to FIG. 5*a*, sectioned perpendicularly to the longitudinal axis of the cannula in the region of the cannula holder.

In the embodiment according to FIGS. 5*a* and 5*b*, the cannula holder 9' essentially has the shape of an equilateral triangle and three guide lugs 35' are provided which are joined to the cannula holder 9' in the region of the centers of the sides of the triangle of the cannula holder 9'. Vane-like directing strips 12 running in the longitudinal direction of the hollow body 3' are joined to the inner wall 30' of the hollow body 3', between which directing strips are arranged the guide lugs 35' of the cannula holder 9'. Each guide lug 35' is joined via a central bridge 39 to the cannula holder 9' and two adjacent directing strips 12 engage with each guide lug 35' in the region of the central bridge 39. Each guide lug 35' is joined to the hollow body 3' via a retainer bridge 13'. The size of the triangle of the cannula holder 9' is chosen so that its apices are positioned with minimal play to the inner wall 30' of the hollow body 3' which, moreover, also applies to the position of guide surface 36' of each guide lug 35' and inner wall 30' of the hollow body 3'. Adjacent directing strips 12 are arranged diverging relative to the inner wall 30' in such a way that they receive a corner 40 of the cannula holder 9' between one another.

In the embodiment according to FIGS. 5*a* and 5*b*, the beaded cap 4 of the bottle 1 is preassembled on the directing strips 12 as far as against the resilient projections 11 of the directing strips 12. On further insertion of this bottle 1 for penetration of the cannula 8, the directing strips 12 are bent radially outward, the beaded cap 4 comes into abutment with the cannula holder 9 and on applying an increased manual force the retainer bridges 13' are broken.

Figure 6A:
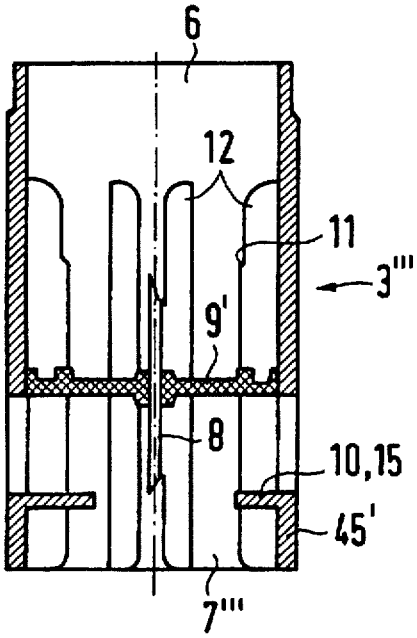
FIG. 6*a* shows a further structure of the apparatus modified with respect to the embodiment according to FIGS. 4*a* and 4*b*, seen in a longitudinal central section.
Figure 7A:
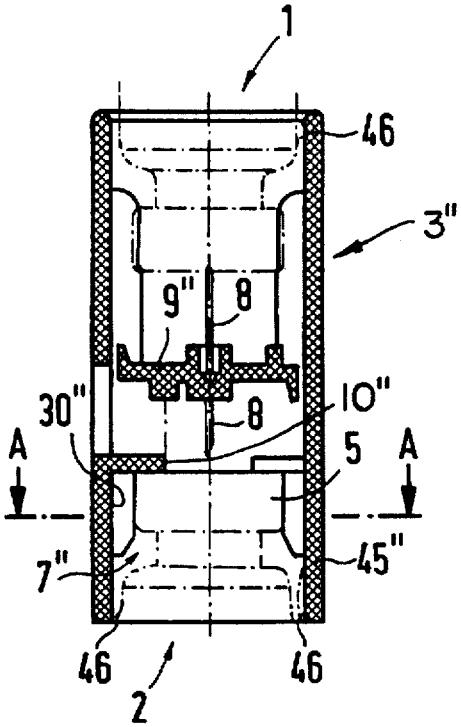
FIG. 7*a* shows a further structure of the apparatus modified with respect to the embodiment according to FIG. 6*a*, seen in a longitudinal central section, with containers, shown in part, introduced at both ends.
Figure 7B:
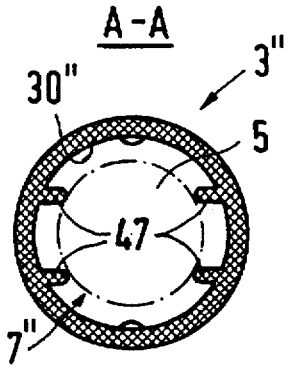
FIG. 7*b* shows a section corresponding to the line A—A in FIG. 7*a*.

In the embodiment according to FIGS. 7*a* and 7*b*, the hollow body orifice 7' (in contrast to the embodiment according to FIG. 6*a*) has a greater longitudinal extension. This is achieved by lengthening the orifice-forming ring section 45" of the hollow body 3". The internal diameter of the ring section is slightly larger than the external diameter of the bottle 2 in the bottle section 46. When the bottle 2 is completely inserted into the lower orifice 7", this bottle 2 contacts, by its beaded cap 5 enclosing the rubber stopper, the stops 10" of the hollow body 3", the beaded cap 5 being guided by ribs 47 which are diametrically joined to the inner wall 30" of the hollow body 3". FIGS. 7*a* and 7*b* show how the external diameter of the beaded cap 5 is less than the external diameter of the container 2 and the ring section 45" extends to laterally of the flange section 46. This effectively prevents tilting of the bottle 2 in the hollow body orifice 7". The upper hollow body orifice 6 is constructed correspondingly, that is, there also, the bottle 1 is guided in the region of its bottle section 46, thus of its maximally expanded region.

Figure 6B:
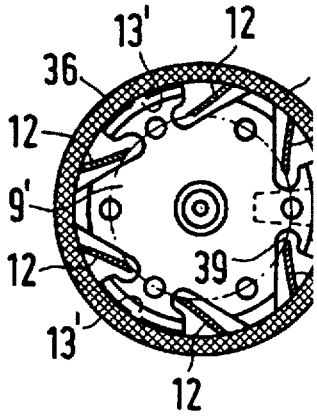
FIG. 6*b* shows a section through the embodiment according to FIG. 6*a*, sectioned perpendicularly to the longitudinal axis of the cannula in the region of the cannula holder.

The transfer apparatus according to FIGS. 4*a* and 4*b* is suitable for injection bottles 1 and 2 having a nominal size of 20 mm. The transfer apparatus according to FIGS. 5*a* and 5*b* serves for transferring a substance from a bottle 1 having a nominal size of 13 mm into a bottle 2 having a nominal size of 20 mm. In the embodiment according to FIGS. 6*a* and 6*b* which is identical to the embodiment according to FIGS. 5*a* and 5*b* except for the structure of the hollow body orifice 7", the apparatus serves for receiving bottles 1 and 2 having a nominal size of 13 mm. The embodiment according to FIGS. 7*a* and 7*b* also serves for receiving bottles 1 and 2 having a nominal size of 13 mm.

What is claimed is:

1. An apparatus for combining a first liquid component in a first container and a second solid or liquid component in a second container, comprising:

a cylindrical hollow body having a first orifice at one end of the hollow body for receiving a closure end portion of the first container and a second orifice at an opposite end of the hollow body for receiving a closure end portion of the second container; and at least one cannula for penetrating a first closure stopper sealing the first container and a second closure stopper sealing the second container, the cannula being mounted in a cannula holder movable in the hollow body along the length of the hollow body, the cannula holder including a lamellar body orientated perpendicular to a length direction of the hollow body and being connected via retainer bridges to an inner wall surface of the hollow body, the retainer bridges being capable of being fractured by applying a manual force greater than penetration force of the cannula for penetrating the first closure stopper.

2. The apparatus as claimed in claim 1, wherein the cannula holder is joined to guide lugs extending toward the inner wall surface of the hollow body.

3. The apparatus as claimed in claim 2, wherein each of the guide lugs has a side facing the inner wall surface of the hollow body, the side having a contour matching a radial contour of the inner wall surface of the hollow body.

4. The apparatus as claimed in claim 2, wherein the guide lugs have a guide surface extending concentrically to the cannula in the length direction of the hollow body.

5. The apparatus as claimed in claim 2, wherein the apparatus includes directing strips joined to the inner wall surface of the hollow body in the length direction of the hollow body, the guide lugs or corners of the cannula holder being arranged between the directing strips.

6. The apparatus as claimed in claim 5, wherein each of the guide lugs is joined via a central bridge to the cannula holder and two of the directing strips engage with a respective one of the guide lugs in the region of the central bridge.

7. The apparatus as claimed in claim 1, wherein the cannula is firmly held in the cannula holder.

8. The apparatus as claimed in claim 1, wherein the first and second orifices are circular.

9. The apparatus as claimed in claim 1, wherein a portion of the cannula holder has a triangular shape.

10. The apparatus as claimed in claim 9, wherein the portion of the cannula holder has an equilateral triangular shape and the cannula holder includes three guide lugs joined to the portion of the cannula holder in the region of centers of sides of the portion.

11. The apparatus as claimed in claim 9, wherein the retainer bridges join the inner wall surface of the hollow body to guide lugs or corners of the cannula holder.

12. The apparatus as claimed in claim 1, wherein the cannula holder has a circular shaped portion and four guide lugs joined to the portion of the cannula holder at the periphery thereof, the guide lugs being offset from one another by 90°.

13. The apparatus as claimed in claim 1, wherein the hollow body includes a collar in a region of the first orifice, the collar including components joined to one another by thin points.

14. The apparatus as claimed in claim 1, wherein the inner wall surface of the hollow body has stops for restricting insertion movement of the second container and/or displacement movement of the cannula holder.

15. The apparatus as claimed in claim 1, wherein the hollow body is elongated adjacent to at least one of the first and second orifices for guiding a respective container in the hollow body.

16. The apparatus as claimed in claim 15, wherein the elongated region of the hollow body has an inner diameter slightly larger than an external diameter of the respective container.

17. A ready-to-use, preassembled, sterilely packaged system, comprising;

the apparatus recited in claim 1;

two containers held in the hollow body out of contact with the cannula; and outer packaging sterilely enclosing the containers and the hollow body.

18. The system of claim 17, wherein one of the two containers contains a substance under reduced pressure.

19. An apparatus for combining a first substance in a first container and a second substance in a second container, comprising:

a hollow body having a first open end for receiving a closure end portion of the first container and a second open end for receiving a closure end portion of the second container;

a cannula holder in the hollow body;

at least one cannula for penetrating a first stopper on the first container and a second stopper on the second container, the cannula extending from the cannula holder; and retainer bridges connecting the cannula holder to an inner wall surface of the hollow body, the retainer bridges being fractured after the cannula penetrates the first stopper during insertion of the first container in the hollow body so that the cannula holder and cannula move toward the second open end of the hollow body.

20. The apparatus of claim 19, wherein the inner wall surface of hollow body includes stops adjacent to the second open end of the hollow body for limiting movement of the second container in the hollow body and/or limiting movement of the cannula holder toward the second open end.

* * * * *